US010323411B2

(12) United States Patent
Ackerman et al.

(10) Patent No.: US 10,323,411 B2
(45) Date of Patent: Jun. 18, 2019

(54) SYSTEMS AND METHODS FOR ASSISTING IN REDUCING THE SPREAD OF FIRE, SMOKE OR HEAT IN A BUILDING

(71) Applicant: Rectorseal, LLC, Houston, TX (US)

(72) Inventors: Eva Ackerman, Houston, TX (US); Yanwei Cen, Houston, TX (US); Martin Everington, Houston, TX (US); Juan Manuel Gonzalez, Katy, TX (US); David Thomas Graham, Katy, TX (US); Carl Bryson McGinnis, Pearland, TX (US)

(73) Assignee: Rectorseal, LLC, Houston, TX (US)

( * ) Notice: Subject to any disclaimer, the term of this patent is extended or adjusted under 35 U.S.C. 154(b) by 0 days.

(21) Appl. No.: 16/008,117

(22) Filed: Jun. 14, 2018

(65) Prior Publication Data

US 2018/0291619 A1 Oct. 11, 2018

Related U.S. Application Data

(63) Continuation of application No. 15/191,993, filed on Jun. 24, 2016, now abandoned.

(60) Provisional application No. 62/389,856, filed on Mar. 11, 2016, provisional application No. 62/391,984, filed on May 16, 2016.

(51) Int. Cl.
*E04B 1/94* (2006.01)
*A62C 2/06* (2006.01)

(52) U.S. Cl.
CPC ..... *E04B 1/947* (2013.01); *A62C 2/065* (2013.01); *E04B 1/944* (2013.01); *E04B 1/946* (2013.01); *E04B 1/948* (2013.01)

(58) Field of Classification Search
CPC ..... E04B 1/947; E04B 1/946; E04B 1/944; E04B 1/948; A62C 2/065
USPC ..... 52/232, 483.1, 241
See application file for complete search history.

(56) References Cited

U.S. PATENT DOCUMENTS 3,934,066 A * 1/1976 Murch ..... E04B 1/94 442/221
4,444,825 A * 4/1984 Vanderstukken ..... B32B 17/10045 428/215
4,632,865 A * 12/1986 Tzur ..... B32B 27/18 428/304.4
4,884,381 A * 12/1989 Betti ..... E01C 11/10 52/741.4
5,098,778 A * 3/1992 Minnick ..... B29C 44/06 442/224
5,137,777 A * 8/1992 Silverman ..... B32B 5/32 428/316.6
5,502,937 A * 4/1996 Wilson ..... B32B 15/14 52/273
5,913,788 A * 6/1999 Herren ..... E04B 2/825 52/236.7
6,783,345 B2 * 8/2004 Morgan ..... E04B 2/7411 425/110

(Continued)

*Primary Examiner* — Joshua K Ihezie
(74) *Attorney, Agent, or Firm* — Marc L. Delflache; Jones Delflache LLP

(57) ABSTRACT

System for assisting in reducing the spread of fire between adjacent rooms in a building proximate to the ceiling thereof includes an elongated header track, at least one elongated filler constructed at least partially of compressible or elastic material and at least one fire-blocker constructed at least partially of fire retarding material.

9 Claims, 4 Drawing Sheets

(56) References Cited

U.S. PATENT DOCUMENTS 7,681,365 B2 * 3/2010 Klein ..... E04B 2/7411 52/1
7,966,778 B2 * 6/2011 Klein ..... E04B 2/825 52/126.3
8,087,205 B2 * 1/2012 Pilz ..... E04B 1/948 52/232
8,353,139 B2 * 1/2013 Pilz ..... E04B 1/948 52/232
8,375,666 B2 * 2/2013 Stahl, Jr. ..... E04B 1/948 52/232
8,578,672 B2 * 11/2013 Mattox ..... E04B 1/948 404/74
8,601,760 B2 * 12/2013 Hilburn, Jr. ..... E04B 1/948 52/232
8,671,632 B2 * 3/2014 Pilz ..... E04B 1/948 52/232
8,720,138 B2 * 5/2014 Hilburn, Jr. ..... E04B 1/948 52/232
8,793,947 B2 * 8/2014 Pilz ..... E04B 2/7457 52/232
8,882,483 B2 * 11/2014 O'Leary ..... B29C 44/182 425/4 R
9,670,666 B1 * 6/2017 Witherspoon ..... E04B 1/948
2002/0056242 A1 * 5/2002 Andresen ..... F16L 5/04 52/220.8
2004/0157012 A1 * 8/2004 Miller ..... A62C 2/06 428/34.1
2006/0137293 A1 * 6/2006 Klein ..... E04B 2/7411 52/782.1
2006/0213138 A1 * 9/2006 Milani ..... F16L 5/04 52/317
2009/0090074 A1 * 4/2009 Klein ..... E04B 2/7411 52/232
2012/0023846 A1 * 2/2012 Mattox ..... E04B 1/948 52/232
2016/0130802 A1 * 5/2016 Pilz ..... E04B 1/948 52/232

* cited by examiner

SYSTEMS AND METHODS FOR ASSISTING IN REDUCING THE SPREAD OF FIRE, SMOKE OR HEAT IN A BUILDING

This application is a continuation of U.S. patent application Ser. No. 15/191,993, filed Jun. 24, 2016, and entitled "Systems and Methods for Assisting in Reducing the Spread of Fire, Smoke or Heat in a Building" which claims priority to U.S. Provisional Patent Application Ser. Nos. 62/389,856, filed on Mar. 11, 2016 and entitled "Intumescent Fire Block Head of Wall Assemblies" and 62/391,984, filed on May 16, 2016 and entitled "Intumescent Fire Block Head of Wall Assemblies", all of which are hereby incorporated by reference herein in their entireties.

FIELD OF THE DISCLOSURE

The present disclosure relates generally to system and methods designed to reduce or prevent the spread of fire, smoke or heat at head-of-wall ceiling joints.

BACKGROUND

"Head-of-wall" ceiling joints are the connection points existing between a building wall and the ceiling. Normally, it is necessary to provide space between the top of the wall and the ceiling to allow for movement of the building. However, the open space or gap at the top of the wall can be a location where fire, smoke and heat spread. In order to contain the spread of smoke and fire, a fire resistant material (e.g. mineral wool) is sometimes placed in the space and a fire-resistant coating sprayed onto the exposed mineral wool. If the space or gap is small enough, a fire-resistant caulk may be used to help fill the gap. These techniques are believed to have disadvantages. For example, these methods are often labor intensive and therefore can be expensive.

Attempts have been made to include fire-blocking materials in the head-of-wall assembly itself. An example of a fire block material sometimes used is intumescent material. Intumescent material typically expands up to many times its original size upon exposure to heat and/or fire and form a char that is fire resistant. However, past attempts at including fire-blocking materials in the head-of-wall assemblies are believed to have disadvantages. For example, various past attempts to add intumescent materials to head-of-wall assemblies have resulted in rubbing between the wallboard and the intumescent material, causing the intumescent material to wear-off or become dislodged.

It should be understood that the above-described features, capabilities and disadvantages are provided for illustrative purposes only and are not intended to limit the scope or subject matter of the appended claims or those of any related patent application or patent. Thus, none of the appended claims or claims of any related application or patent should be limited by the above discussion or construed to address, include or exclude each or any of the above-cited features, capabilities or disadvantages merely because of the mention thereof herein.

Accordingly, there exists a need for improved systems, articles and methods useful in connection with reducing the spread of fire, smoke or heat between adjacent rooms at the head-of-wall ceiling joints having one or more of the attributes or capabilities described or shown in, or as may be apparent from, the various portions of this patent application.

BRIEF SUMMARY OF THE DISCLOSURE

In some embodiments, the present disclosure involves a system for assisting in reducing the spread of fire between adjacent rooms in a building proximate the ceiling(s) thereof. The rooms are separated by a wall having at least one vertical wall board coupled to a plurality of vertical studs. Each wall board and vertical stud has upper and lower ends. The system includes an elongated header track having a base configured to be coupled to the ceiling and first and second spaced-apart flanges extending downwardly therefrom. The upper end of each vertical stud extends between the flanges and is spaced downwardly from the base of the header track to form a space therebetween and allow for relative movement between the wall and the ceiling. The upper end of each wall board abuts the outer side of one of the flanges and is spaced downwardly from the ceiling to form a gap therebetween and allow for relative movement between the wall and the ceiling.

At least one elongated filler constructed at least partially of compressible or elastic material is configured to be compressed into the gap formed between at least one wall board and the ceiling. Each filler is configured to expand and contract as the wall and ceiling move relative to one another during normal, typical or expected use of the building to at least substantially fill the gap. The elongated filler has at least one elongated slit or cavity formed therein and which extends at least partially through the length thereof. At least one fire-blocker constructed at least partially of fire retarding material is disposed within the slit(s) or cavity(ies) formed in each filler. The fire-blocker is substantially surrounded by the associated filler to protect the fire-blocker from at least substantial direct exposure to sunlight, moisture and ambient air from the adjacent room.

In various embodiments, the present disclosure involves a system for assisting in reducing the spread of fire between adjacent rooms in a building proximate the ceiling(s) thereof. The rooms are separated by a wall having at least one vertical wall board coupled to a plurality of vertical studs. The system includes an elongated header track having a base configured to be coupled to the ceiling and first and second spaced-apart flanges extending downwardly therefrom. The upper end of each vertical stud extends between the flanges and is spaced downwardly from the base of the header track to form a space therebetween and allow for relative movement between the wall and the ceiling. The upper end of each wall board abuts the outer side of one of the flanges and is spaced downwardly from the ceiling to form a gap therebetween and allow for relative movement between the wall and the ceiling.

At least one layer of elongated filler constructed at least partially of compressible or elastic material is configured to be disposed within at least one gap formed between at least one wall board and the ceiling. At least one layer of fire-blocker constructed at least partially of fire retarding material is disposed adjacent to and in layered relationship with the at least one layer of elongated filler.

Accordingly, the present disclosure includes features and advantages which are believed to enable it to advance building construction technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figures 1, 2:
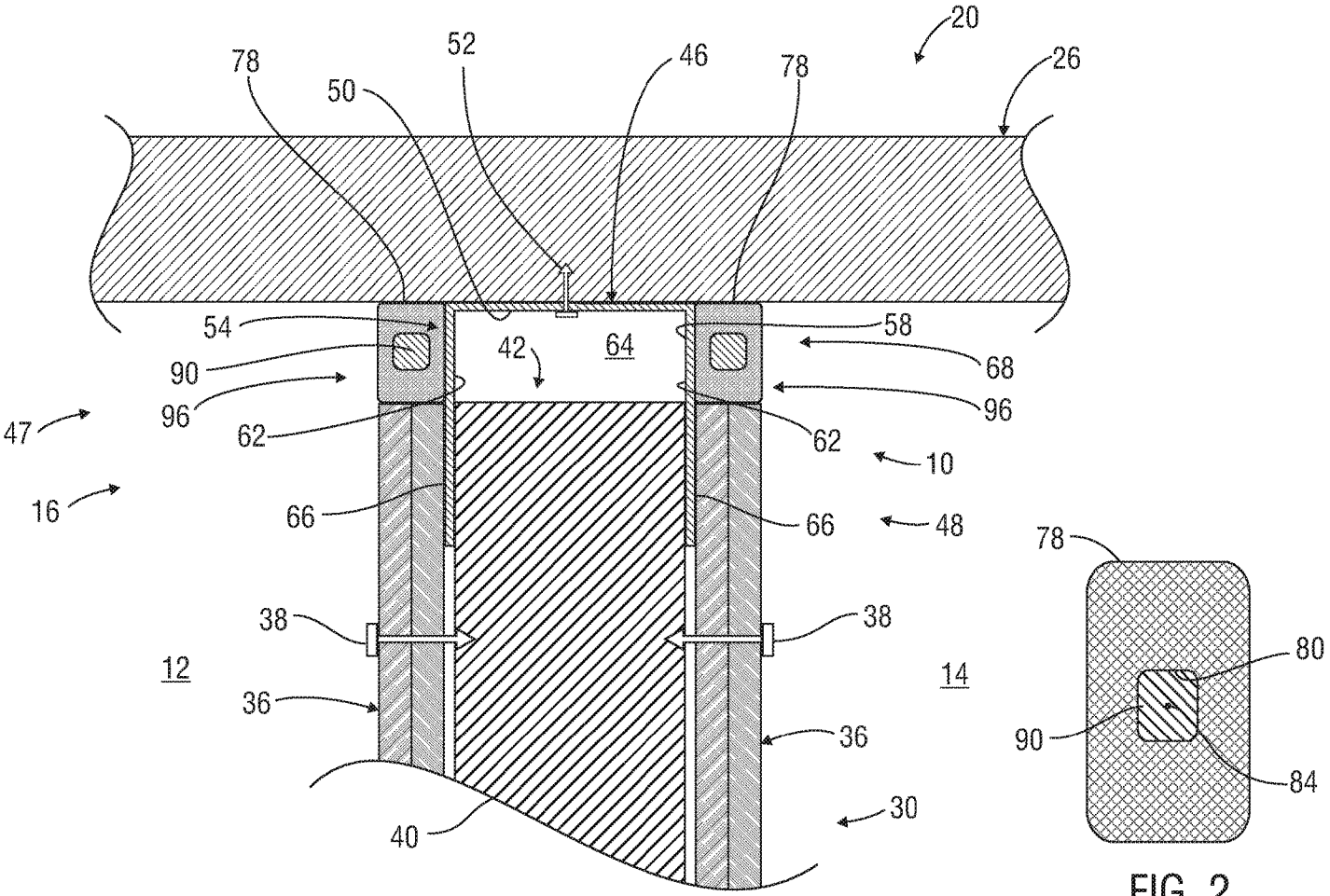
FIG. 1 is a cross-sectional view of an embodiment of a fire-retarding system in accordance with the present disclosure.
FIG. 2 is an isolated cross-sectional view of the exemplary elongated filler and fire-blocker arrangement shown in FIG. 1.

The present invention now will be described more fully hereinafter with reference to the accompanying drawings, in which at least some preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application or any patent or patent application claiming priority hereto. On the contrary, the intention is to cover all modifications, equivalents and alternatives falling within the spirit and scope of this disclosure or any appended claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. The use of a particular or known term of art as the name of a component herein is not intended to limit that component to only the known or defined meaning of such term (e.g. bar, connector, rod, cover, panel, bolt, screw, pin). Further, this document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

As used herein, the terms "elongated" and variations thereof mean having an average length that is greater than its average width. As used herein, the terms "substantially", "generally" and variations thereof means and includes (i) completely, or 100%, of the referenced parameter, variable or value, and (ii) a range of values less than 100% based upon the typical, normal or expected degree of variation or error for the referenced parameter, variable or value in the context of the particular embodiment or use thereof, such as, for example, 90-100%, 95-100% or 98-100%.

Referring initially to FIG. 1, an embodiment of a fire retarding system 10 is shown. The exemplary fire retarding system 10 is useful for assisting in reducing the spread of fire, smoke or heat into adjacent rooms 12, 14 in a building 20 proximate to the ceiling(s) 26, or at the head-of-wall ceiling joint 16, of the rooms 12, 14. The illustrated rooms 12, 14 are shown separated by a wall 30 having at least one vertical wall board 36 coupled to a plurality of vertical studs 40. The exemplary system 10 include at least one elongated, U-shaped, header track 46 having a base 50 configured to be coupled to the ceiling 26 with one or more connectors 52, such as bolts, tacks, nails, screws, pins etc. as is and becomes further known. In many embodiments, the base 50 may be rigidly connected to and/or abut the ceiling 26.

The illustrated header track 46 also includes first and second spaced-apart flanges 54, 58 extending vertically downwardly from the base 50. Each illustrated flange 54, 58 includes an inner side 62, and an outer side 66. A present commercially available example of a component that may be used as the header track 46 in some embodiments of the present disclosure is the "MaxTrack" by Clark Dietrick Building Systems.

In this embodiment, the upper end 42 of each vertical stud 40 extends between the flanges 54, 58 of the header track 46 and abuts the respective inner sides 62 thereof. At the same time, the upper end 40 of each vertical stud 40 is spaced downwardly from the base 50 of the header track 46, forming a space 64 therebetween. Since the illustrated vertical studs 40 are not rigidly coupled to the header track 46, the spaces 64 allow for relative movement between the wall 30 and the ceiling 26 (and potentially other components), and/or for any other suitable purpose. The exemplary wall board(s) 36 are coupled to the studs 40 below the header track 46 with connectors 38, such as bolts, tacks, nails, screws, pins etc. as is and becomes further known. In this embodiment, each wall board 36 abuts the outer side 66 of the respective adjacent flange 54, 58 and is also spaced downwardly from the ceiling 26 to form a gap 68 therebetween (See also FIGS. 8-9). In other embodiments, the wall board 36 may not abut the outer side of the adjacent flange 54, 58. The illustrated gap 68 allows for relative movement between the wall 30 and the ceiling 26 (and potentially other components), and/or for any other desired purpose(s).

Still referring to the embodiment FIG. 1, the exemplary system 10 also includes at least one elongated filler 78 and at least one fire-blocker 90 disposed within each gap 68 formed between each wall board 36 and the ceiling 26. The filler 78 and fire-blocker 90 may have any desired purpose. For example, in some embodiments, the filler(s) 78 may help at least partially fill the gap(s) 68 to assist in preventing or reducing unwanted sound and air flow migration between the adjacent rooms 12, 14 through the gap(s) 68. In many embodiments, in the case of a fire in the building 20, the filler(s) 78 and/or fire-blocker(s) 90 may assist in preventing or reducing the migration of smoke, fire or heat between the rooms 12, 14 through the gap(s) 68. For another example, in some embodiments, the filler 78 may at least partially assist in shielding or protecting the associated fire-blocker (s) 90 from degradation, such as due to direct exposure to sunlight, moisture and/or ambient air. However, in some embodiments, the system 10 may not include any filler 78, but only the fire-blocker 90 or may alternate between configurations of fire-blocker 90 with and without the filler 78 in any desired arrangement.

The elongated filler 78 and fire-blocker 90 may have any suitable form, configuration, construction and operation. For example, in some embodiments, the filler 78 may be constructed at least partially of compressible and/or elastic material and configured to be compressed (e.g. squeezed or stuffed) into the gap 68 so that it will expand as the gap 68 grows in size and contract as the gap 68 shrinks in size throughout normal, typical or expected relative movement between the wall(s) 30 and ceiling(s) 26 during use of the building 20 to at least substantially fill the gap 68 at all times. For example, the filler 78 may be in the form of a foam or sponge constructed of elastomeric material, such as polyethylene, polystyrene, polypropylene or polyurethane. The filler 78 may be constructed of material that is organic or inorganic, or a combination of both. A few present commercially available examples of material that may be used as the elongated filler 78 in some embodiments are the "Mormflex" and "OCFoam" by Nomaco Engineering Foam Solutions. In other embodiments, the filler 78 may only partially fill the gap 68.

Referring now to FIG. 2, the exemplary elongated filler 78 may have any desired cross-sectional shape. In the illustrated embodiment, the filler 78 has a generally rectangular cross-sectional shape. However, in other embodiments the filler 78 may have a square, circular, oval, hexagonal or other cross-sectional geometric configuration or shape.

Still referring to FIG. 2, the exemplary fire-blocker 90 may be constructed at least partially of any desired, suitable fire retarding material. As used herein, the terms "fire retarding" and variations thereof mean having the capability to stop or reduce the spread of fire, decrease heat or smoke generated by fire or increase char formation. For example, the fire-blocker 90 may be constructed at least partially of intumescent material that swells or expands upon exposure to heat. For example, in some embodiments, the intumescent material may swell to at least about two times its original volume at about 100° C. For another example, in various environments, the intumescent material may swell up by a factor of 100 upon being exposed to heat between about 150° C. to about 200° C. One presently commercially available intumescent material that can be used as the fire-blocker 90 in some embodiments in the "BlazeSeal" by the present applicant, The Rectorseal Corporation. If desired, the fire-blocker 90 may be constructed of a mixture of one or more intumescent materials and one or more non-intumescent materials. In other embodiments, the fire-blocker 90 may include a mixture of two or more intumescent materials or a mixture of two or more non-intumescent materials. For yet another example, the fire-blocker 90 may include intumescent or other fire retarding material sprayed onto or into, or applied as a coating or affixed with adhesive or mechanical fastener(s) (e.g. nails) to, one or more other materials or components, such as the filler 78.

In some embodiments, the fire-blocker 90 may be infused into the filler 78 so that it is not a separate component. The filler 78 would thus have fire-blocking capabilities. For example, intumescent fire-blocker material may be infused into a foam filler 78. One presently commercially available intumescent-infused foam material useful in some embodiment of the system 10 is the "NORSEAL FS1000" series by Saint-Gobain Performance Plastics. If desired, multiple layers of fire-blocking infused filler 78 may be stacked together, such as with the use of an adhesive. One example of a presently commercially available adhesive that may be useful to affix the aforementioned layers together is the "3M Foam & Fabric 24 Spray" adhesive by 3M.

The fire-blocker 90 may have any desired shape and configuration. For example, the fire-blocker 90 may include one or more elongated portions (e.g. strips, sticks), one or more non-elongated portions (e.g. patches or squares), or a combination thereof.

Referring again to FIGS. 1-2, the fire-blocker 90 and filler 78 may be arranged in the gap(s) 68 in any suitable manner and configuration. For example, the filler 78 may at least partially surround or encapsulate the fire-blocker 90 in the gap 68. This sort of configuration may be used for any desired purpose, such as to reduce the quantity of fire-blocker 90 used or needed in the system 10. This may be advantageous for cost-efficiency, such as when the material used for the fire-blocker 90 is more expensive than the material used for the filler 78. For another example, when the filler 78 at least partially surrounds or encapsulates the fire-blocker 90, the filler 78 may at least partially or substantially shields or insulate the fire-blocker 90 from direct contact with UV light, moisture and/or ambient air from the adjacent room(s) 12, 14, which may degrade the fire-blocker 90 and reduce its fire-retarding capabilities. In some embodiments, the filler 78 may entirely surround the fire-blocker 90, while, in other embodiments, the filler 78 may only partially surround the fire-blocker 90. In some instances where the filler 78 fully or partially surrounds the fire-blocker 90, fire or heat contacting the filler 78 may cause at least part of the filler 78 to burn away, exposing the fire-blocker 90 so that it will perform as intended. In other instances, the fire-blocker 90, even though surrounded by the filler 78, may still be activated by the heat or fire to perform as intended (e.g. to assist in preventing or reducing the migration of smoke, fire or heat between the rooms 12, 14 through the gap(s) 68).

The fire-blocker 90 may be at least partially surrounded or encapsulated by the filler 78 in the gap 68 in any suitable manner. In this embodiment, the elongated filler 78 includes one or more internal slits, or cavities, 80 within which the fire-blocker(s) 90 are contained. The terms "slit" and "cavity" are used interchangeably herein in this context because the filler 78 may be constructed of a flexible material in which a "cavity" is not easily formed or would effectively collapse until something were placed inside it. In such instances, a mere "slit" cut into the filler 78 along a longitudinal axis 84 thereof may suffice at effectively forming a cavity around the fire-blocker(s) 90 when it is placed therein. In the illustrated embodiment, the cavity 80 extends substantially through the length of the filler 78. The exemplary fire-blocker 90 is elongated and completely surrounded by the filler 78. In other embodiments, one or more cavities 80 may extend through only one or more desired portions of the filler 78, the fire-blocker 90 may not be elongated, the filler 78 may only partially, or not, surround the fire-blocker 90 or a combination thereof.

The exemplary fire-blocker(s) 90 may be inserted into the cavity(ies) 80 in the filler 78 in any suitable manner. For example, one or more elongated fire-blockers 90 may be inserted into the cavity 80 at one or both ends of the filler 78. In some embodiments, one or more slits or openings may extend from the cavity 80 to a side of the filler 78 to allow insertion of the fire-blocker 90 therethrough and into the cavity 80. For example, an opening may be formed in the outer side 96 of the filler 78 and extending inwardly to the cavity 80 so that the fire-blocker 90 may be inserted therethrough. Note, the outer side 96 of the filler 78 is the side farthest from the header track 46. For yet another example, the fire-blocker 90 may be intumescent material that is injected in a flowable state into the cavity 80. It should be noted, however, the manner of insertion of the fire-blocker 90 into the cavity 80 is not limiting upon the present disclosure or any of the appended claims or claims of any related patent or patent application, except and only to the extent as may be expressly recited in a particular claim and only for that claim and any claims depending therefrom.

Still referring to FIGS. 1-2, in this embodiment, the filler 78 and fire-blocker 90 are provided in the gaps 68 formed between vertical wall boards 36 and the ceiling 26 on both sides 47, 48 of the header track 46. However, in other embodiments, the filler 78 and fire-blocker 90 may be provided in the gap(s) 68 formed between vertical wall boards 36 and the ceiling 26 on only one side 47, 48 of the header track 46, provided in alternating fashion from side to side 47, 48 along the wall(s) 30 or any other desired configuration.

Figure 3A:
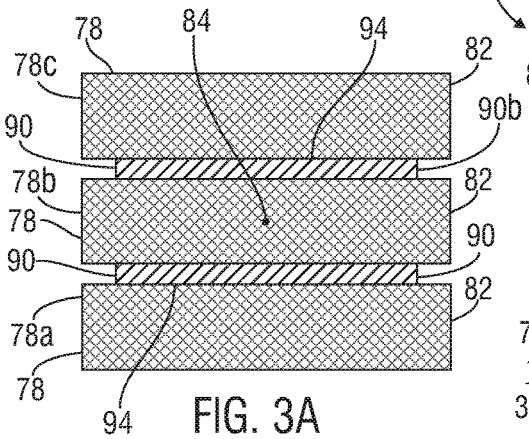
FIG. 3A is an isolated cross-sectional view of another embodiment of an elongated filler and fire-blocker arrangement in accordance with the present disclosure.
Figure 3B:
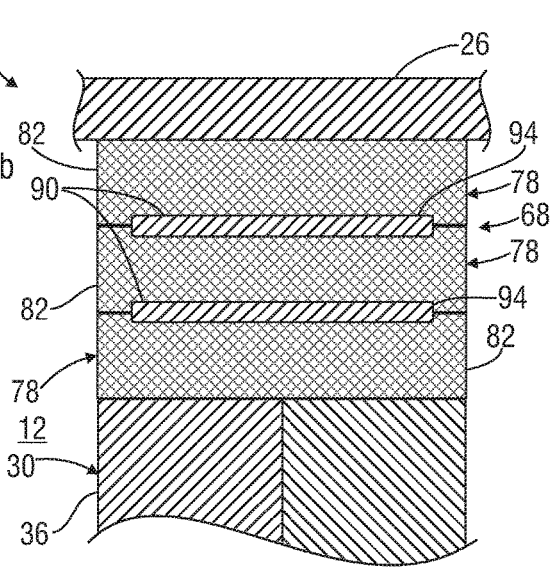
FIG. 3B is an isolated cross-sectional view of the exemplary elongated filler and fire-blocker arrangement of FIG. 3A shown disposed in a gap between an exemplary wall board and ceiling.

Referring now to FIG. 3A, in other embodiments, the fire-blockers 90 may not be enclosed in slits, or cavities, 80 (e.g. FIG. 2) formed in the filler 78. In this particular example, the illustrated fire-blocker 90 and elongated filler 78 are shown in a stacked or layered relationship. Two elongated sheets, or strips, 94 of fire-blockers 90 are shown sandwiched between three elongated sections 82 of filler 78, respectively. While the exemplary sections 82 of filler 78 cover (and thus at least partially shield) the top and bottom of each illustrated strip 94 of fire-blocker 90, the sides of the fire-blocker strips 94 are initially shown exposed. However, as represented in FIG. 3B, once the illustrated sections 82 of filler 78 are compressed in the gap 68 between the top of the vertical wall board 36 and the ceiling 26, the sides of the sections 82 collapse at least partially, substantially, or completely around the side edges of the exemplary sheets 94 of fire-blocker 90, assisting in at least partially surrounding, or encapsulating, and shielding them.

Figure 4:
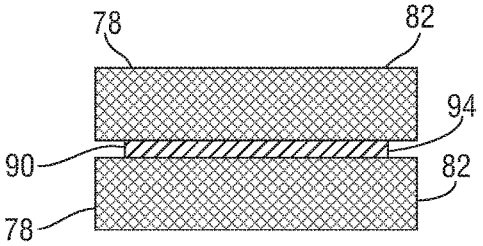
FIG. 4 is an isolated cross-sectional view of another embodiment of an elongated filler and fire-blocker arrangement in accordance with the present disclosure.
Figure 5:
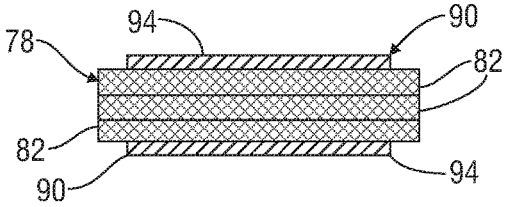
FIG. 5 is an isolated cross-sectional view of another embodiment of an elongated filler and fire-blocker arrangement in accordance with the present disclosure.
Figure 6:
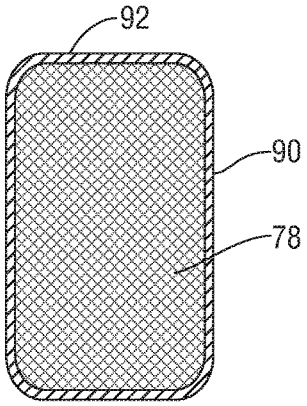
FIG. 6 is an isolated cross-sectional view of another embodiment of an elongated filler and fire-blocker arrangement in accordance with the present disclosure.

Any desired number of layers or other configuration of fire-blockers 90 and fillers 78 may be used. There may be one, two, three, four, five, six or more layers of fire-blocker 90 and/or filler 78 or any combination thereof (e.g. three layers of fire-blocker 90 and four layers of filler 78, six layers of filler 78 and seven layers of fire-blocker 90, etc.). For example, FIG. 4 illustrates one strip 94 of fire-blocker 90 sandwiched between two sections 82 of filler 78, which will surround the strip 94 similarly as shown and described with respect to the embodiment of FIGS. 3A-B if compressed into the gap 68. In other embodiments, such as shown in FIGS. 5 and 6, the fire-blocker 90 may be positioned external to, or outside of, the filler 78. In FIG. 5, distinct layers of fire-blocker 90 (e.g. sheets 94) are shown positioned on the top and bottom of the filler 78. In this example, if the illustrated filler 78 is compressed into the gap 68, the sides of the filler 78 may still at least partially collapse around the side edges of the fire-blocker sheets 94 to completely or at least substantially surround them.

In some embodiments, all or part of the fire-blocker 90 may not be surrounded, encapsulated or shielded by the filler 78. For example, in FIG. 6, the fire-blocker 90 includes one or more layers that at least partially surround the filler 78. If desired, the fire-blocker 90 may form a skin 92 around the filler 78, such as by being sprayed on or affixed with adhesive (See also FIGS. 8-9).

It should be noted that any layer or section of fire-blocker 90 (e.g. strip 94) or filler 78 (e.g. section 82) may itself include multiple layers. For example, the filler 78 in FIG. 5 is constructed of three layers, or sections, 82.

The exemplary filler 78 (and fire-blocker 90) may entirely, or only partially, initially and/or subsequently fill the associated gap 68. In the embodiment of FIGS. 1-3B, for example, the filler 78 is configured to be squeezed or stuffed into the gap 68 so that it expands and will hopefully substantially, or entirely, fill the gap 68 and maintain that relationship during use of the building 20. In contrast, in the embodiments of FIGS. 8 and 9, the filler 78 and fire-blocker 90 are designed, at least initially, not to fill the gap 68. As shown, the exemplary filler 78 and fire-blocker 90 initially only partially fill the gap 68. For example, the system 10 may be configured so that the fire-blocker 90 will expand if exposed to fire or heat and at that time at least partially or substantially fill the gap 68 to assist in preventing further migration of fire, smoke or heat.

Figure 8:
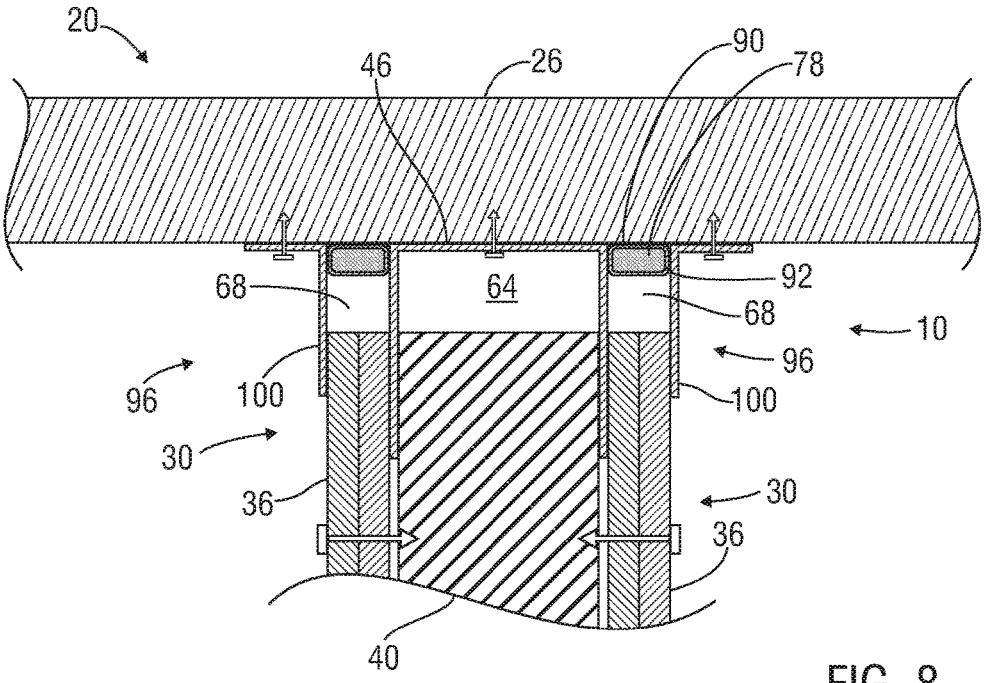
FIG. 8 is a cross-sectional view of another embodiment of a fire-retarding system in accordance with the present disclosure.
Figure 9:
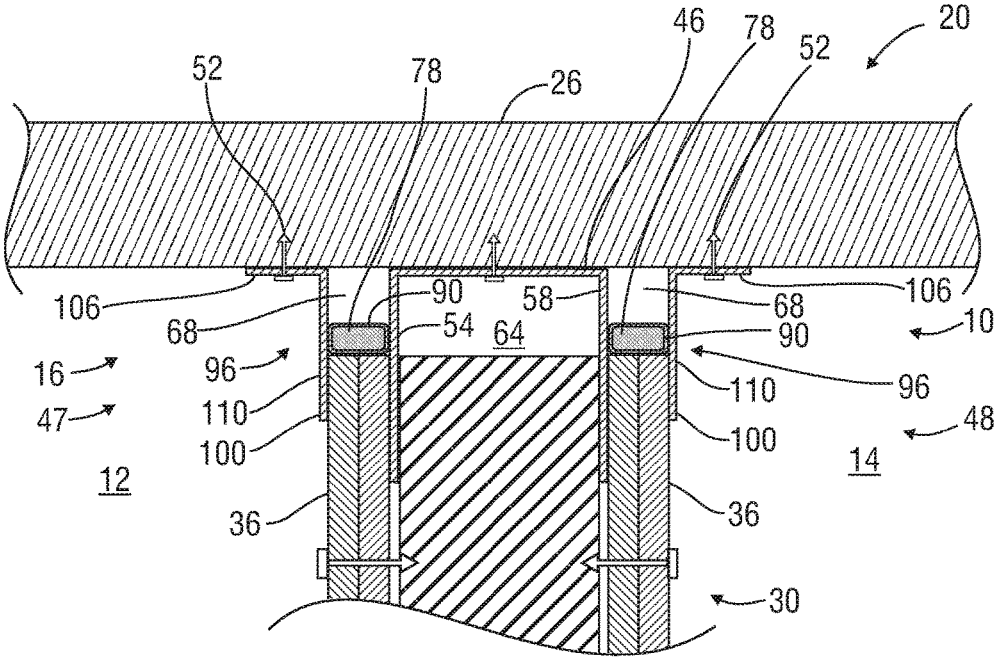
FIG. 9 is a cross-sectional view of another embodiment of a fire-retarding system in accordance with the present disclosure.

Still referring to FIGS. 8-9, the filler 78 and fire-blocker 90 may be installed in the gap 68 to initially partially fill the gap in any suitable manner. For example, the filler 78 and/or fire-blocker 90 may be affixed to the ceiling 26 (e.g. FIG. 8), the top of the adjacent wall board 36 (e.g. FIG. 9) or the adjacent side protector 100 (if included) as will be described further below, such as with connectors (e.g. nails), adhesive, other suitable mechanism or a combination thereof. In the illustrated embodiments, the fire-blocker 90 has adhesive on its outer surface (and potentially also on its inner surface). Since the exemplary fire-blocker 90 is provided on the outside of the filler 78, the fire-blocker 90 may be adhered to the ceiling 26 (e.g. FIG. 8) or the top of the adjacent wall board 36 (e.g. FIG. 9) via adhesive.

In other embodiments, only the fire-blocker 90 may be provided in the gap(s) 68 or a combination of only fire-blocker 90 and filler 78/fire-blocker 90 configurations may be provided at different locations (e.g. on opposites sides of the header track 46) as desired. For example, when only fire-blocker 90 is included, the fire-blocker 90 may take the form of intumescent strips that can be adhered, nailed or otherwise coupled to the ceiling 26 or the top of the adjacent wall board 36, similarly as the filler 78/fire-blocker 90 configurations shown in FIGS. 8 & 9.

In yet other embodiments, the filler 78/fire-blocker 90 combinations or only fire-blocker 90 may be placed atop the top of the adjacent wall board 36, or placed or friction fit in the gap 68 or a portion thereof, without being affixed or coupled to any other component.

Figure 7:
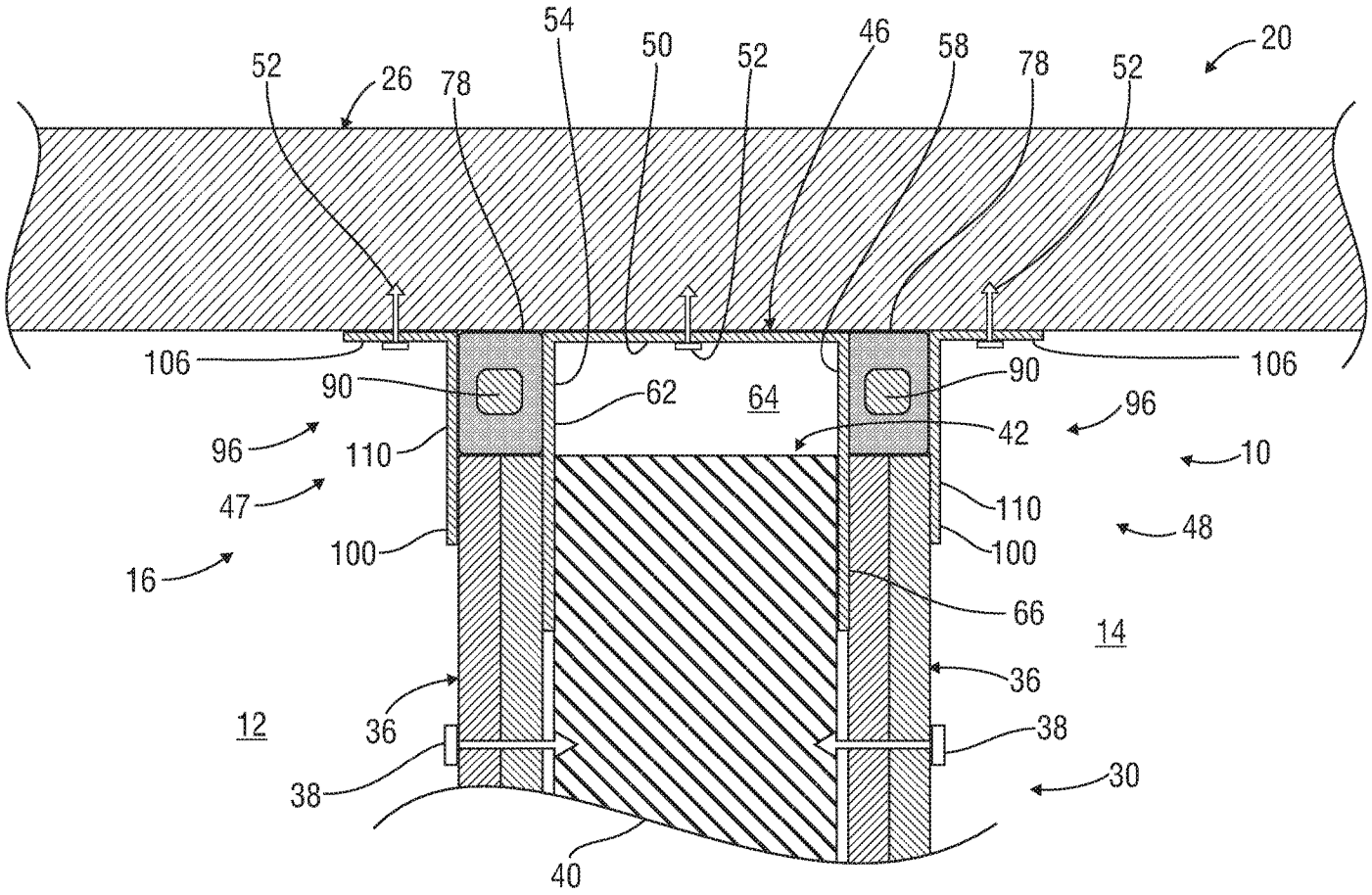
FIG. 7 is a cross-sectional view of another embodiment of a fire-retarding system in accordance with the present disclosure.

Referring now to FIG. 7, in another independent aspect of the present disclosure, the fire retarding system 10 may include one or more elongated side protectors 100 to assist in shielding or protecting the filler(s) 78 and/or the fire-blocker(s) 90, provide support for the filler(s) 78 and/or the fire-blocker(s) 90 or other components, prevent the filler(s) 78 and/or the fire-blocker(s) 90 or other components from falling out of the gap 68, provide an additional barrier to fire, smoke and heat migration between the adjacent rooms 12, 14 proximate to the ceiling(s) 26, provide aesthetic enhancement to the head-of-wall ceiling joint 16, any other desired purpose or a combination thereof.

The side protector 100 may have any suitable form, configuration, construction and operation. For example, in some embodiments, the side protector 100 may be an elongated, substantially right-angled metallic member, such as a section of angle iron. In this embodiment, the side protector 100 includes a base 106 configured to be secured to the ceiling 26 proximate to the outer side 96 of the illustrated filler 78 and a leg 110 extending downwardly therefrom and covering the outer side 96 of the filler 78. The exemplary base 106 is shown coupled to the ceiling 26 with one or more connectors 52, such as bolts, tacks, nails, screws, pins etc. In many embodiments, the base 106 is rigidly connected to and/or abuts the ceiling 26.

The exemplary leg 110 of the side protector 100 extends downwardly adjacent to the entire outer side 96 of the filler 78 and part of the adjacent wall board(s) 36. In some embodiments, the leg 110 of the side protector 100 abuts and is flush with the outer side 96 of the filler 78 and/or exposed fire-blocker 90 (e.g. FIGS. 8-9) and the wall board 36. In other embodiments, the leg 110 of the side protector 100 may be in close proximity to, but not abut or be flush with, the wall board 36 and the outer side 96 of the filler 78 and/or exposed fire-blocker 90.

When included, the side protector 100 may be provided on either or both sides 47, 48 of the header track 46. In some embodiments, the side protector 100 may be formed with a predesigned profile and appearance to serve as a decorative component at the head-of-wall ceiling joint 16.

An example cost-effective method of assembly of the layered embodiment of filler 78 and fire-blocker 90 shown in FIG. 3A will now be described. A first 1/16" thick layer 90*a* of intumescent fire-blocker 90 is placed on the top surface of a first ½" thick layer 78*a* of foam filler 78. If desired, the first fire-blocker layer 90*a* can be affixed to the first filler layer 78*a*, such as with adhesive. A second ½" thick layer 78*b* of foam filler 78 is placed atop the first layer 90*a* of intumescent fire-blocker 90. If desired, the second filler layer 78*b* can be affixed to the first fire-blocker layer 90*a*, such as with adhesive. A second 1/16" thick layer 90*b* of intumescent fire-blocker 90 is placed atop the top surface of the second filler layer 78*b*. If desired, the second fire-blocker layer 90*a* can be affixed to the second filler layer 78*a*, such as with adhesive. A third ½" thick layer 78*c* of foam filler 78 is placed atop the second layer 90*b* of intumescent fire-blocker 90. If desired, the third filler layer 78*c* can be affixed to the second fire-blocker layer 90*b*, such as with adhesive. An example presently commercially available foam useful as filler layers 78*a-c* is the "Mormflex" foam by Nomaco Engineering Foam Solutions. An example presently commercially available intumescent material useful as fire-blocker layers 90*a-c* is the "BlazeSeal" by the present applicant, The Rectorseal Corporation. An example presently commercially available adhesive that may be useful to affix the aforementioned layers together is the "3M Foam & Fabric 24 Spray" adhesive by 3M.

In accordance with all of the above embodiments, the exemplary fire retarding systems 10 is configured to protect the fire-blocker 90 from at least significant degradation, easy and quick to assemble and install, reliable, unlikely to become dislodged and cost-effective.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of any appended claims, and may be made and used by one of ordinary skill in the art without departing from the spirit or teachings of the invention and scope of this disclosure and any appended claims. Thus, all matter herein set forth or shown in the accompanying drawings should be interpreted as illustrative, and the scope of the disclosure and any appended claims should not be limited to the embodiments described and shown herein.

The invention claimed is:

1. A system for reducing the spread of fire between adjacent rooms in a building having a common ceiling, the rooms being separated by a wall having at least one vertical wall board coupled to a plurality of vertical studs, each wall board and vertical stud having upper and lower ends, the system comprising:

an elongated header track having a base configured to be coupled to the ceiling and first and second spaced-apart flanges extending downwardly therefrom, said flanges each having an inner side and an outer side, wherein the upper end of each vertical stud extends between said flanges, the upper end of each vertical stud being spaced downwardly from said base of said header track to form a space therebetween and allow for relative movement between the wall and the ceiling, further wherein the upper end of each wall board abuts said outer side of one of said flanges and is spaced downwardly from the ceiling to form a gap therebetween and allow for relative movement between the wall board and the ceiling;

at least one layer of elongated filler constructed at least partially of compressible or elastic material and configured to be disposed within at least one said gap formed between at least one wall board and the ceiling, said at least one layer of elongated filler having a top surface and a bottom surface; and at least one layer of fire-blocker constructed at least partially of fire retarding material and being disposed adjacent to said top surface of said at least one layer of elongated filler and in layered relationship with at least one said layer of elongated filler within at least one said gap formed between at least one wall board and the ceiling so that said at least one layer of fire-blocker is generally proximate the ceiling, wherein each said layer of fire-blocker and each said layer of filler has a width and first and second side edges, wherein said width of each said layer of fire-blocker is smaller than said width of each said layer of filler so that said first and second side edges of each said layer of fire-blocker are offset inwardly relative to said first and second side edges of each said layer of filler; and wherein every layer of fire-blocker present in the system is sandwiched between two elongated fillers.

2. The system of claim 1 wherein each said layer of filler is configured to be compressed into said gap formed between at least one wall board and the ceiling and configured to expand and contract as the wall and ceiling move relative to one another to at least substantially fill said gap and substantially surround said at least one associated layer of fire-blocker to protect said at least one layer of fire-blocker from at least substantial direct exposure to sunlight, moisture and ambient air from the adjacent room.

3. The system of claim 2 wherein each said layer of fire-blocker has an inner side closest to said header track when said layer of fire-blocker is positioned in at least one of said gaps and an outer side farthest from said header track when said layer of fire-blocker is positioned in at least one of said gaps, further including an elongated side protector having a base configured to be secured to the ceiling proximate to said outer side of at least one of said layers of fire-blocker and a leg extending downwardly therefrom to cover said outer side of said at least one layer of fire-blocker.

4. The system of claim 1 wherein said at least one layer of filler and said at least one layer of fire-blocker occupy only part of at least one said gap.

5. The system of claim 1 wherein said at least one layer of filler and said at least one layer of fire-blocker are configured to be affixed to the ceiling.

6. The system of claim 1 wherein said at least one layer of filler and said at least one layer of fire-blocker are configured to be affixed to the upper end of at least one of the wall boards.

7. The system of claim 1 wherein said at least one layer of filler and said at least one layer of fire-blocker are placed upon and not affixed to the upper end of at least one of the wall boards.

8. The system of claim 1 wherein said at least one layer of filler and said at least one layer of fire-blocker are configured to be stuffed into at least one said gap and completely fill said at least one gap.

9. A system for reducing the spread of fire between adjacent rooms in a building having a common ceiling, the rooms being separated by a wall having at least one vertical wall board coupled to a plurality of vertical studs, each wall board and vertical stud having upper and lower ends, the system comprising:

an elongated header track having a base configured to be coupled to the ceiling and first and second spaced-apart flanges extending downwardly therefrom, wherein the upper end of each vertical stud extends between said flanges, the upper end of each vertical stud being spaced downwardly from said base of said header track to form a space therebetween and allow for relative movement between the wall and the ceiling, at least one layer of elongated filler constructed at least partially of compressible or elastic material and configured to be disposed between at least one wall board and the ceiling, said at least one layer of elongated filler having a top surface and a bottom surface; and at least one layer of fire-blocker constructed at least partially of fire retarding material and being disposed adjacent to said top surface of said at least one layer of elongated filler and in layered relationship with at least one said layer of elongated filler between at least one wall board and the ceiling so that said at least one layer of fire-blocker is generally proximate the ceiling, wherein each said layer of fire-blocker and each said layer of filler has a width and first and second side edges, wherein said width of each said layer of fire-blocker is smaller than said width of each said layer of filler so that said first and second side edges of each said layer of fire-blocker are offset inwardly relative to said first and second side edges of each said layer of filler; and wherein every layer of fire-blocker present in the system is sandwiched between two elongated fillers.

* * * * *